United States Patent [19]

Ohlsson

[11] 4,191,105

[45] Mar. 4, 1980

[54] PRINTING APPARATUS

[75] Inventor: Jarl E. S. I. Ohlsson, St-Julien en Genevois, France

[73] Assignee: Sisenca S.A., Geneva, Switzerland

[21] Appl. No.: 875,624

[22] Filed: Feb. 6, 1978

[30] Foreign Application Priority Data

Feb. 7, 1977 [CH] Switzerland ..... 1436/77

[51] Int. Cl.[2] ..... B41F 1/28

[52] U.S. Cl. ..... 101/415.1; 101/128.1; 101/132

[58] Field of Search ..... 101/415.1, 132, 132.5, 101/136–145, 153, 157, 174, 216, 217, 248

[56] References Cited

U.S. PATENT DOCUMENTS

| | | | |
|---|---|---|---|
| 2,002,321 | 5/1935 | Kluitmann | 101/132 |
| 3,413,920 | 12/1968 | Kaneko | 101/248 |
| 3,721,189 | 3/1973 | Bray | 101/415.1 |
| 3,752,075 | 8/1973 | Fusco | 101/415.1 |
| 3,793,950 | 2/1974 | Kaneko | 101/132 |

*Primary Examiner*—Edgar S. Burr
*Assistant Examiner*—A. Heinz
*Attorney, Agent, or Firm*—Young & Thompson

[57] ABSTRACT

Printing apparatus comprising a plate carrying impression cylinder and a flexible printing plate detachably securable thereon. Because the printing plate may be large and flexible, special apparatus is provided for positioning the plate on the cylinder and removing it therefrom, comprising a suction head carried by an endless member for reciprocal movement between the cylinder and a storage cylinder on which the flexible plate can be wound.

2 Claims, 9 Drawing Figures

PRINTING APPARATUS

This invention relates to printing apparatus.

It is known that in various printing processes, for example in offset printing processes, use may be made of flexible metal plates, for example of zinc, aluminium, stainless steel or other alloys, which are about some tenths of a micron in thickness, the forms to be printed being applied to such plates by means of different well-known processes. Such plates are intended to be wrapped around a cylinder known in the art as a "plate cylinder."

The very substantial development which offset and typographic processes have undergone over several years has obviously resulted in the design of machines of large size, in particular in order to increase the profitability of such processes. However, this involves using printing plates of larger and larger dimensions and it is difficult, if not impossible, to handle such plates, which are at least 1.5 m (for example 2.5 to 3 m) in length, whereas conventional plates are from 1 to 1.5 m in length.

According to the invention there is provided a printing apparatus comprising at least one plate cylinder, at least one printing plate provided with printing regions, and means for setting in position and for automatically fixing at least one said printing plate around the cylinder.

Apparatus embodying the invention can be so designed as to make it possible to use printing plates of large dimensions.

Apparatus embodying the invention can be designed to carry out any of a variety of printing processes, in particular printing by offset, typography and photogravure.

The invention will now be further described, by way of example, with reference to the accompanying diagrammatic drawings, in which.

Figure 1B:
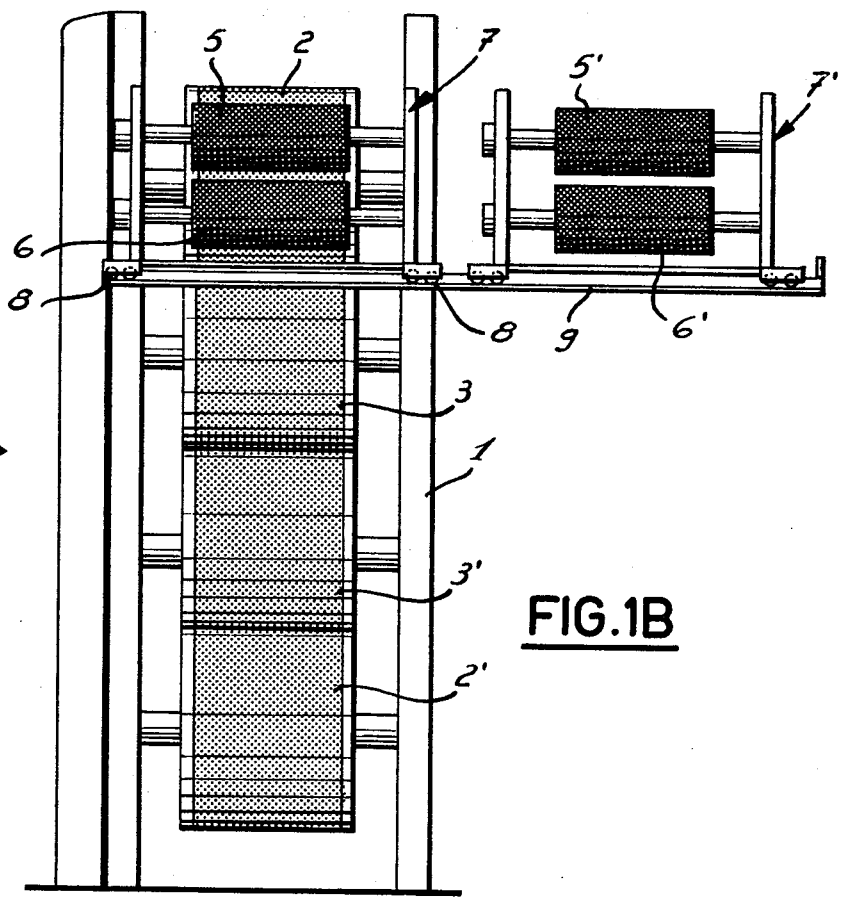
FIG. 1A is a side view and FIG. 1B is a rear view of a first embodiment of the invention.
Figure 1A:
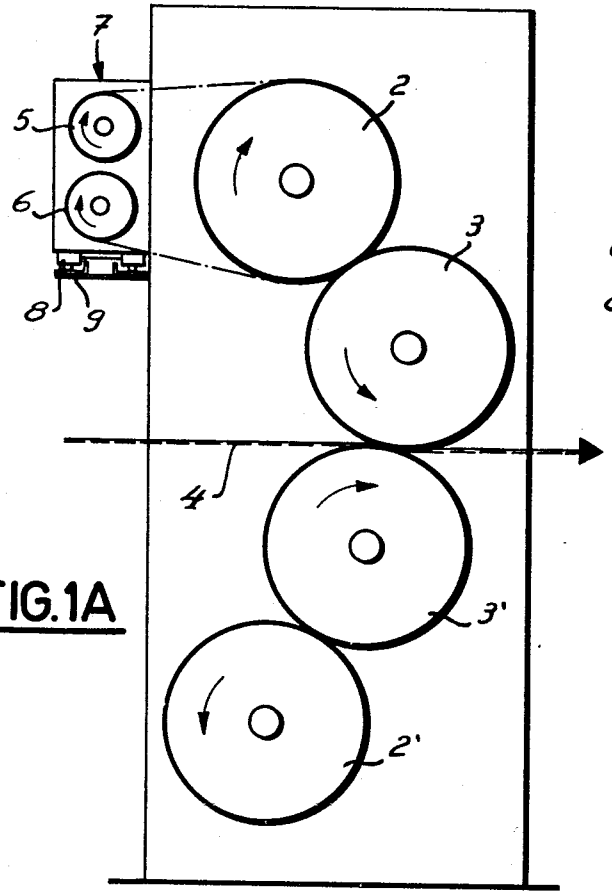

FIGS. 1A and 1B show diagrammatically an offset printing machine which constitutes a first embodiment of the invention and is of the four-cylinder type for printing on both sides of the paper at once. The machine comprises a frame 1 on which are mounted four cylinders with their axes parallel, namely two plate cylinders 2, 2' and two blanket cylinders 3, 3', that is to say cylinders which are covered with a flexible layer for example of rubber, a sheet 4 of paper to be printed being passed between the two cylinders 3 and 3'.

In the diagrammatic showing of FIGS. 1A and 1B, other conventional equipment, such as means for driving the cylinders, inking and damping rolls, etc., are not shown.

The machine shown in FIGS. 1A and 1B additionally comprises means for setting in position and automatically fixing on the plate cylinders 2, 2' printing plates which are previously provided with printing regions. The positioning and fixing means are more particularly described with reference to FIGS. 2 to 4 and comprise, for the plate cylinder 2, a feed cylinder 5 and a receiving cylinder 6 which are mounted rotatably on parallel axes fixed to a frame 7, the frame 7 being provided with trains of rollers 8 whereby the frame 7 can be displaced by rolling on rails 9 fixed to the frame 1 of the offset machine (see FIGS. 1A and 1B). Similar means (not shown) are provided for setting in position and fixing printing plates on the plate cylinder 2'.

A flexible offset printing plate 10, which is previously provided with printing regions, is pre-wound on the feed cylinder 5. The length of the plate 10 is equal to the circumference of the cylinder 2, and leading and trailing ends of the plate 10 are provided with flanges 11 and 11', respectively. The flange 11' of the trailing end is disposed in an axial groove 12 provided in the feed cylinder 5, and the flange 11 of the other end is temporarily, in the rest condition of the apparatus, held between two members 13 and 13' of the frame 7.

This first embodiment of the invention also comprises means for handling and transferring the plate 10, such means comprising a suction member 14. The suction member 14 is mounted so as to be displaceable along an axis extending approximately from the feed cylinder 5 to the plate cylinder 2 (as shown by an arrow A in FIG. 2) and is also movable along an axis perpendicular on the above-mentioned axis of displacement (namely along an axis shown by an arrow B in FIG. 2). More specifically, the suction member 14 is carried by a carriage 15 which is driveable with a linear movement along the axis A by an endless chain 16, and is connected to the carriage 15 by means of a piston 17 extensible along the axis B.

The way in which this first embodiment of the invention is operative to position and automatically fix the printing plate 10 to the cylinder 2 will now be described with reference to FIG. 2.

The suction member 14 is moved to the leading end of the plate 10 which is wound around the feed cylinder 5, that is to say, the end whose edge flange 11 is held between the members 13 and 13' of the frame 7, and the suction action is started. Then, the suction member 14 is withdrawn upwardly along the direction indicated by the arrow B, by retraction of the piston 17, so as to entrain therewith the above-mentioned leading end of the plate 10 and to cause the flange 11 to come out from between the members 13 and 13'.

Figure 2:
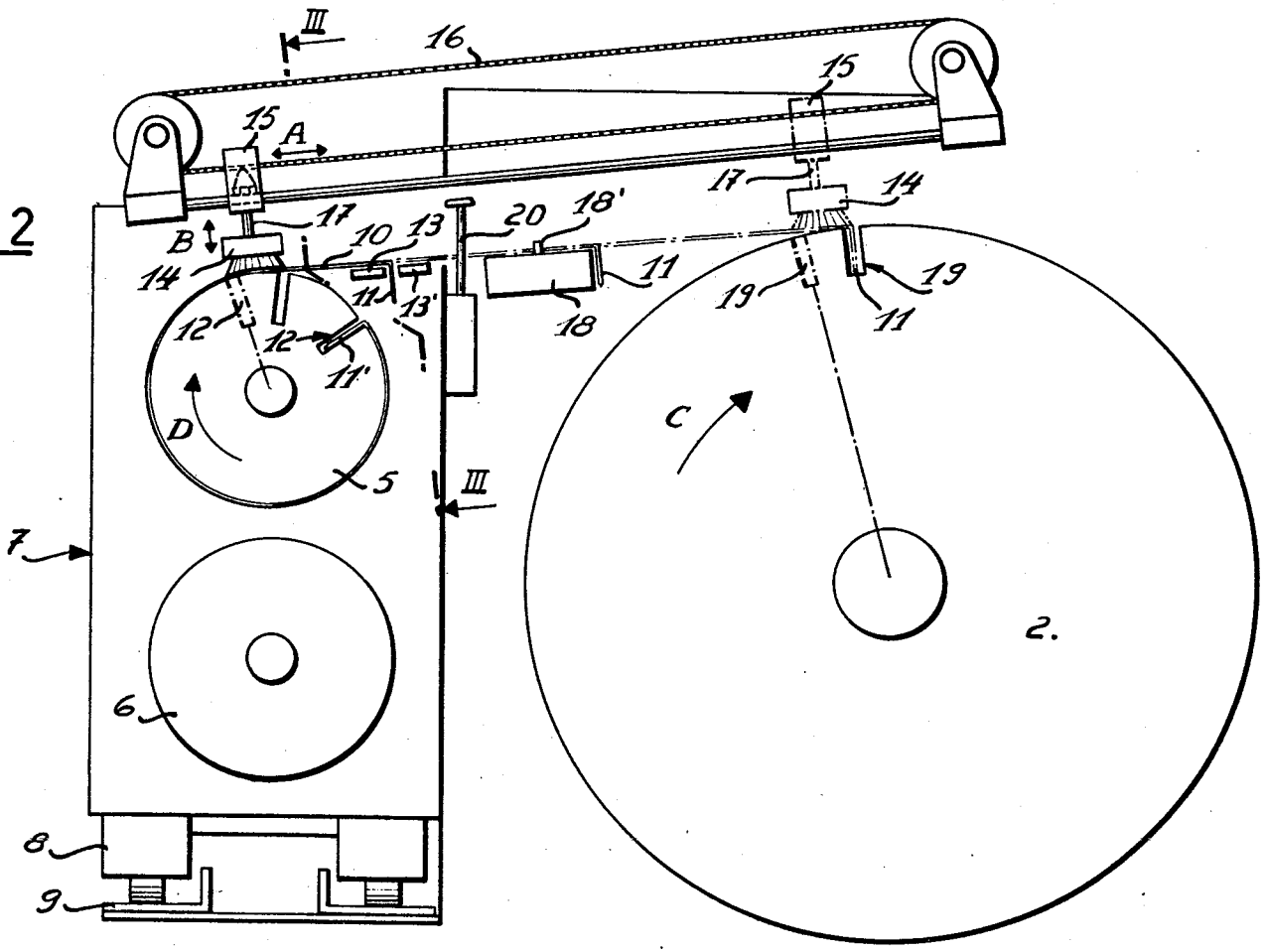
FIGS. 2 and 4 are side views of two respective details of the first embodiment.
Figure 3:
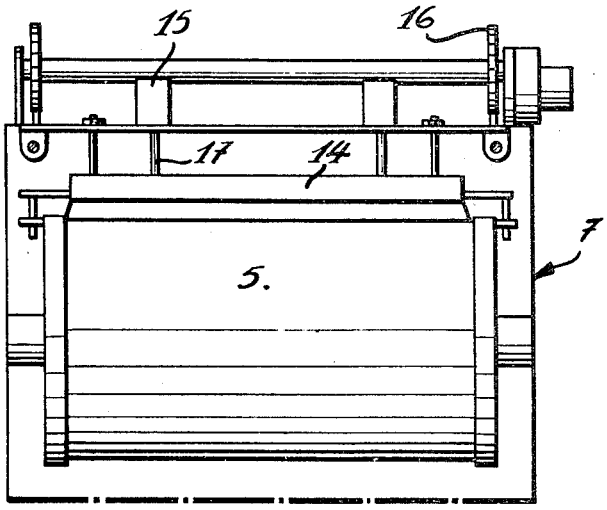
FIG. 3 is a view in section taken along the line III—III in FIG. 2.

The leading end of the plate 10, still entrained by the suction member 14, is then moved, by displacing the suction member in the direction indicated by arrow A and then in the direction indicated by arrow B, to a positioning table 18, as shown in FIG. 2. As it passes over the table 18, the positioning of the printing plate 10, which is previously provided with printing regions, is adjusted and registered.

The suction member 14 then pulls the leading end of the plate 10 to the cylinder 2 and, by a movement which is first in an upward direction and then in a downward direction, as indicated by the arrow B, places the flange 11 of the leading end into an axial groove 19 provided in the cylinder 2. The suction action is then stopped to free the plate 10 from the member 14, and the member 14 returns to its starting position.

The plate cylinder 2, which is non-magnetic, rotates in the direction indicated by an arrow C and entrains the plate 10 which, as it is unwound from the feed cylinder 5 as indicated by an arrow D, is positioned on the surface of the cylinder 2.

When the plate 10 has been almost completely unwound from the feed cylinder 5, and when the groove 12 in the feed cylinder 5 is in the position shown in chain dotted lines in FIG. 2, the suction member 14 can then engage the trailing end of the plate 10, move the flange 11' of the trailing end out of the groove 12, and move the trailing end to the cylinder 2, to introduce the flange 11' into the groove 19 in the cylinder, which groove is then in the position shown in chain-dotted lines. The suction action of the member 14 is then stopped and the pre-registered plate 10 is completely unwound and fixed around the cylinder 2, which is therefore ready for printing operations.

The machine also comprises a movable support 20 which follows the movements of the suction and entrainment member 14 in the directions indicated by the arrow B in such a way that when the flexible plate 10 is raised by the member 14 it is constantly supported by the support 20.

When the printing plate 10 is to be changed, operations similar to those described above with reference to FIG. 2 for fitting the plate 10 onto the cylinder 2 are first effected, but the operations are performed in a different order in order to remove the plate 10 from the cylinder 2 and to wind it around the receiving cylinder 6, as will now be described with reference to FIG. 4. The suction member 14 is first moved to engage the leading end of the plate 10, in order to disengage the flange 11 from the groove 19 and to move the flange 11 into an axial groove 21 in the receiving cylinder 6. The suction action is then stopped and the member 14 can be returned from the position shown in chain-dotted lines to its starting position which is shown in solid lines.

Figure 4:
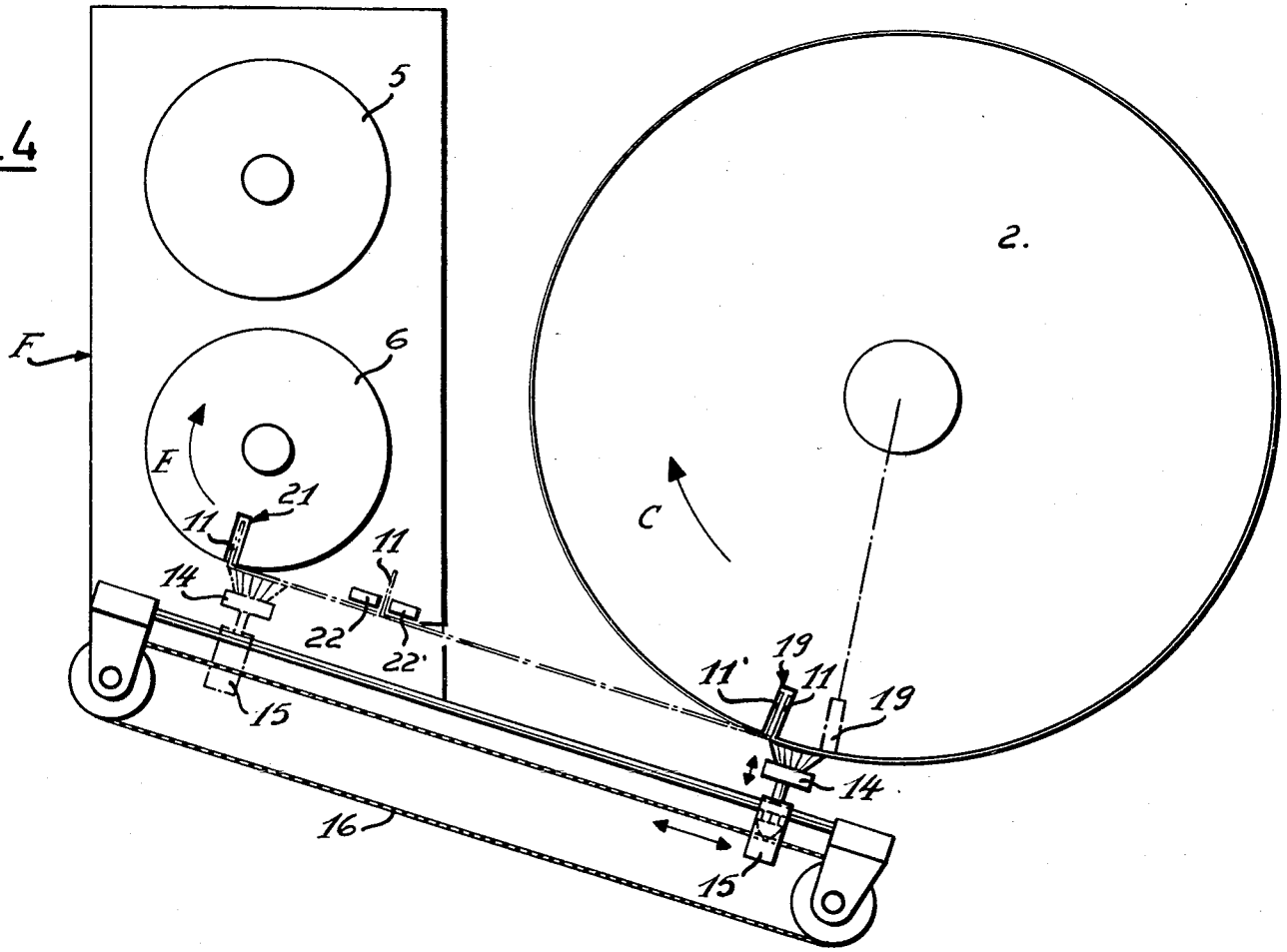

The plate 10 is then wound around the receiving cylinder 6, which rotates in the direction indicated by an arrow E, until, the plate cylinder 2 simultaneously rotating in the direction indicated by the arrow C, the plate 10 has been almost completely unwound from the cylinder 2 and the groove 19 in the cylinder 2 is in the position shown in chain-dotted lines in FIG. 4. The suction member 14 can then engage the trailing end of the plate 10 to remove the flange 11' from the groove 19 and move it to a position between two members 22 and 22' of the frame 7.

As shown in FIG. 1B, the frame 7 with the used plate 10 wound around the receiving cylinder 6, can then be replaced by a fresh frame 7' comprising a feed cylinder 5' around which there is wound a fresh plate 10' already provided with printing regions, and a receiving cylinder 6'. The operating cycle can then begin again.

Figure 6:
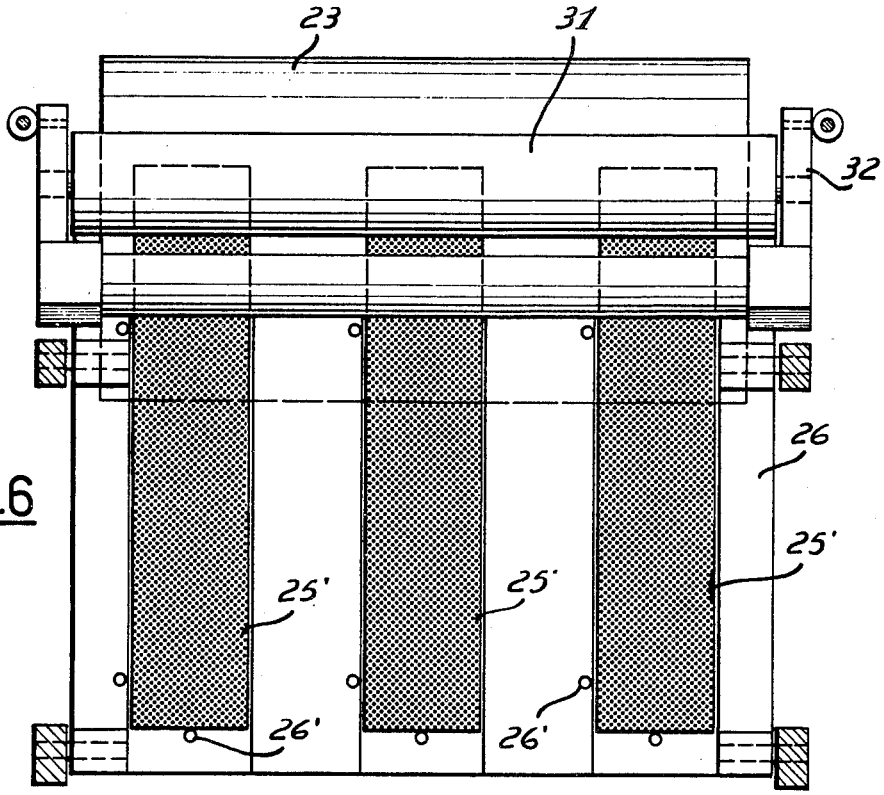
FIG. 6 is a rear view of a part of the second embodiment.
Figure 5A:
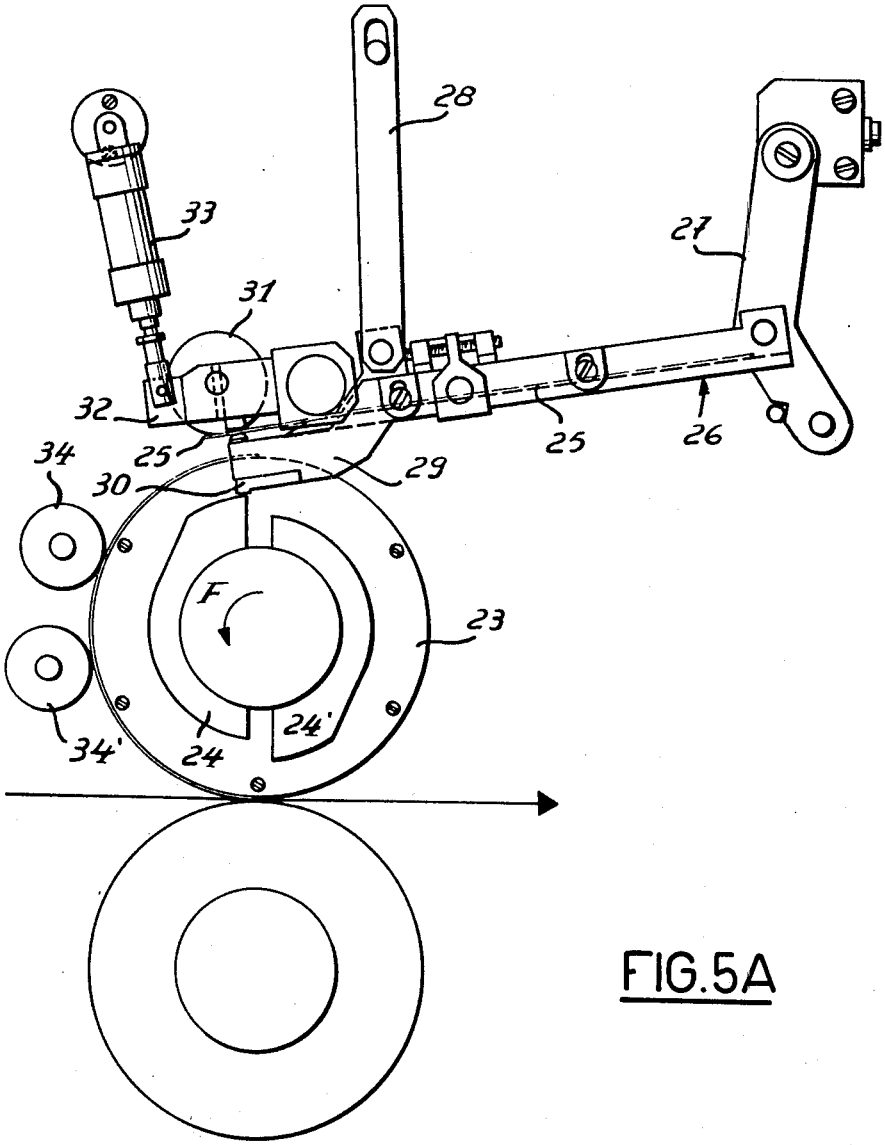
FIGS. 5A and 5B are side views of a second embodiment of the invention, in two different positions.
Figure 5B:
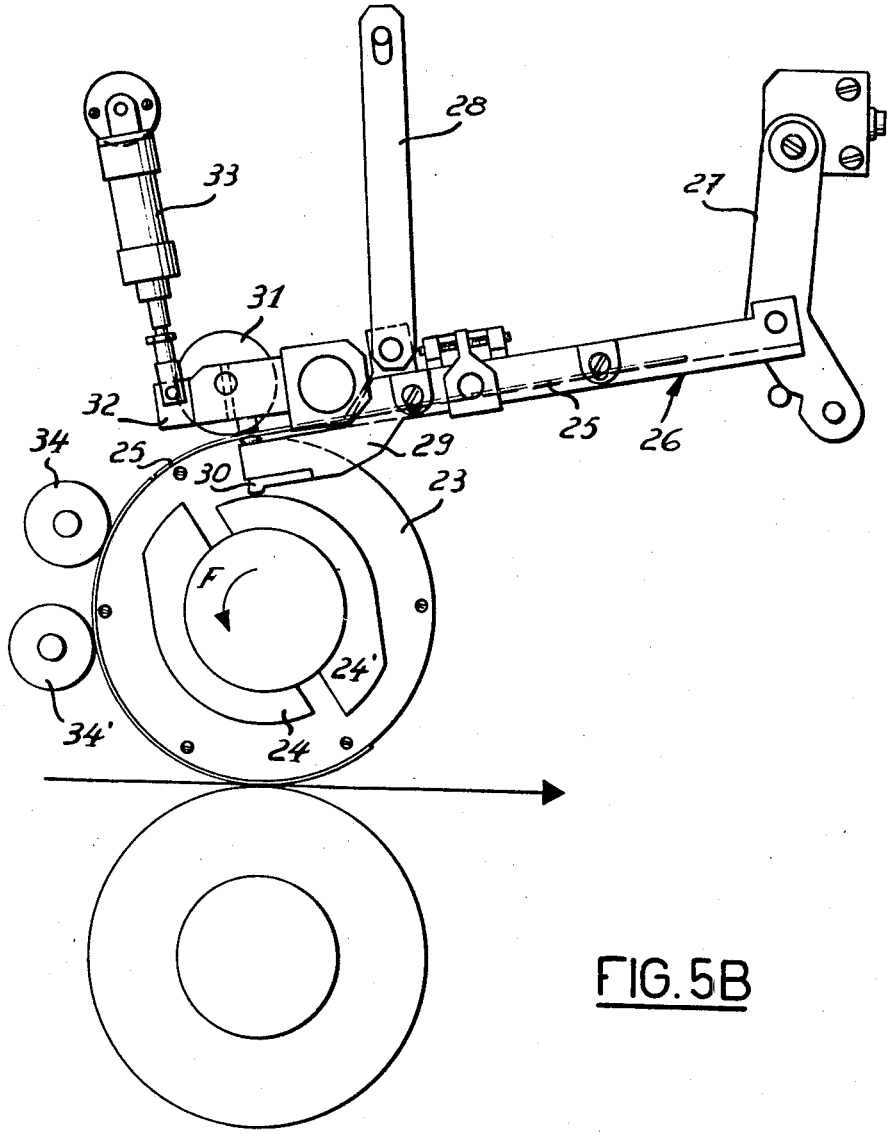

A printing apparatus constituting a second embodiment of the invention is diagrammatically illustrated in FIGS. 5A, 5B and 6 and comprises a magnetic plate cylinder 23 of which at least one end is provided with two cams 24 and 24'.

In this embodiment, offset or typographic printing plates 25 which are previously provided with printing regions, which have a base of a magnetic material, for example steel, and which have a length that corresponds to half the circumference of the cylinder 23, are loaded directly onto a positioning table 26 provided with positioning projections 26'. One of the ends of the table 26 is pivotally mounted on an arm 27 which is in turn pivotally mounted on a fixed frame (not shown), the other end of the table being supported by a pivoted arm 28. The table 26 is extended forwardly by a positioning member or arm 29 provided with a shoe 30 which bears on the surfaces of the cams 24 and 24'.

At the end of the arm 29 the plate 25 is also subjected to the action of a pressure roller 31 which is journaled on an arm 32. One end of the arm 32 is pivoted on a fixed frame (not shown) and the other end is subjected to the thrust action of a pneumatic cylinder 33.

In the position shown in FIG. 5A, the arm 29 is pushed upwardly by the cam 24 and the plate 25 is therefore disposed above the surface of the cylinder 23. As the cylinder 23 continues to rotate in the direction of an arrow F, the arm 29 is then pushed downwardly, onto the surface of the cam 24', under the action of the pneumatic cylinder 33. At the same time, the plate 25 is applied against the surface of the cylinder 23 by the roller 31, and the plate 25 becomes secured to the surface of the cylinder 23 by magnetic force, as shown in FIG. 5B. To ensure that the plate 25 is secured firmly to the cylinder 23 and is in proper form thereon, the plate 25 is also subjected to the action of two rollers 34 and 34' which also serve as inking rollers.

As shown in FIG. 6, the plate 25 can be replaced when performing certain particular printing operations, for example by three narrower plates 25'.

Figure 7:
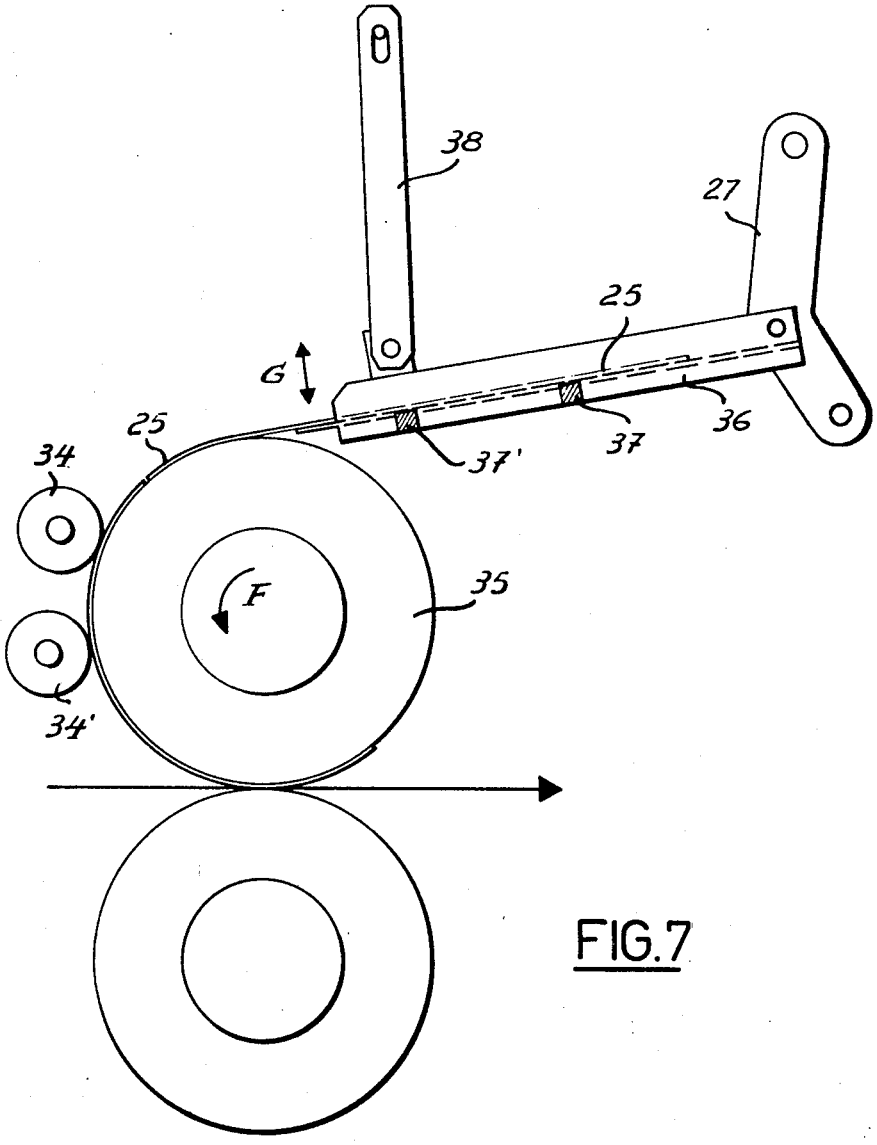
FIG. 7 is a side view of an alternative form of the second embodiment.

In an alternative form of the second embodiment, as shown in FIG. 7, the apparatus does not comprise particular means for applying the plate 25, already provided with its printing regions, to the magnetic plate cylinder, in this case referenced 35. A positioning table 36 which, like the table 26 shown in FIGS. 5A and 5B, is displaceable in the direction indicated by an arrow G, is therefore fixed for pivotal movement to a first arm 27 on the one hand and to a second arm 38 on the other hand. The table 36 has two magnetic members 37 and 37' which are intended temporarily to hold the plate 25.

To place the plate 25 in position on the magnetic cylinder 35, the table 36 is lowered into the position shown in FIG. 7. The leading end of the flexible plate 25 is then attracted and is applied by magnetic force to the cylinder 35, which is temporarily stationary. The cylinder 35 is then progressively set in rotation in the direction indicated by the arrow F and entrains therewith the plate 25, the magnetic force of the cylinder 35 exerted during the pulling movement then being greater than a magnetic holding force applied to the plate 25 by the magnetic members 37 and 37'. The members 37 and 37' are therefore useful in particular for preventing the plate 25 from sliding on the table 36 during the positioning operation.

I claim:

1. A printing apparatus comprising at least one plate cylinder, at least one printing plate provided with printing regions, and means for setting in position and for automatically fixing at least one said printing plate around the cylinder, the plate cylinder being non-magnetic and comprising an axial slot and the printing plate having at each of its ends a fixing flange to be introduced into said slot, the apparatus also comprising means for storing the plate, means for transferring the plate from the storage means to a position around the plate cylinder, and positioning means disposed between the storage means and the cylinder, the storage means comprising a feed cylinder around which the plate is wound, the diameter of the feed cylinder being less than the diameter of the plate cylinder, a receiving cylinder for receiving the plate after use thereof, and a movable frame on which the feed cylinder and the receiving cylinder are rotatably mounted.

2. Apparatus according to claim 1, said transferring means comprising a suction member adapted to retain a portion of the plate by suction, and means for moving the suction member along a first axis extending between the storage means and the plate cylinder and along a second axis perpendicular to the first axis.

* * * * *